United States Patent [19]

Ruskin

[11] 4,450,998

[45] May 29, 1984

[54] STAPLE-DRIVING TOOLS

[76] Inventor: Henry Ruskin, 21 Nomahegan Ct., Cranford, N.J. 07016

[21] Appl. No.: 333,312

[22] Filed: Dec. 22, 1981

[51] Int. Cl.[3] ..... B21J 15/38

[52] U.S. Cl. ..... 227/8; 227/132; 227/156

[58] Field of Search ..... 227/8, 129, 131–133, 227/156

[56] References Cited

U.S. PATENT DOCUMENTS

| | | | |
|---|---|---|---|
| 2,137,642 | 11/1938 | Cavanagh | 227/132 |
| 3,131,397 | 5/1964 | Miller | 227/132 |
| 3,940,044 | 2/1976 | La Pointe | 227/8 |

*Primary Examiner*—E. R. Kazenske

*Assistant Examiner*—Douglas D. Watts

[57] ABSTRACT

The disclosed tacker involves a spring-impelled staple driver operated by a spring having opposite movable ends, one being operated to compress the spring and the other being releasable to drive the staple driver. The described release means involves a stationary latch and means for pushing the latched part of the staple driver off the latch and, thus, into its guided staple-driving path. A safety device is included which blocks operation of the tacker to eject a staple if the tacker is not pressed against the staple-receiving surface at the moment of release. A one-piece plastic jacket is described enclosing the metal frame of the tacker. The staple-driving effort can be adjusted to adapt the tacker to soft or hard staple-receiving work.

20 Claims, 31 Drawing Figures

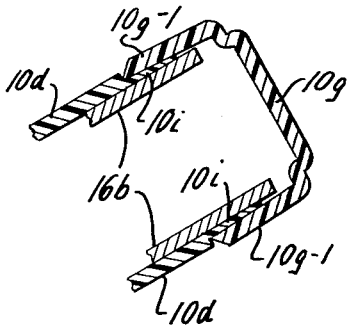
FIG. 29
FIG. 2
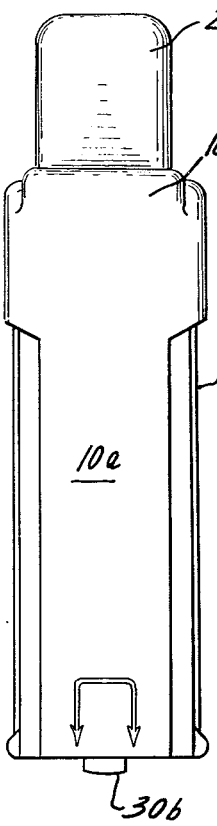
FIG. 1
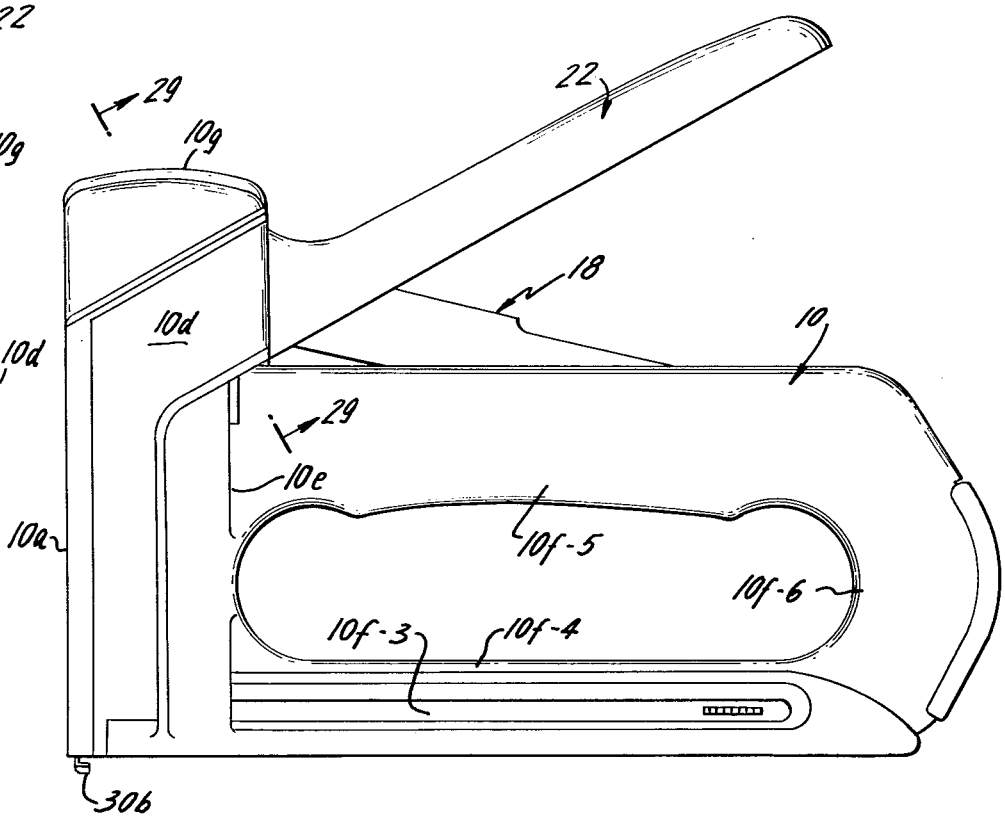
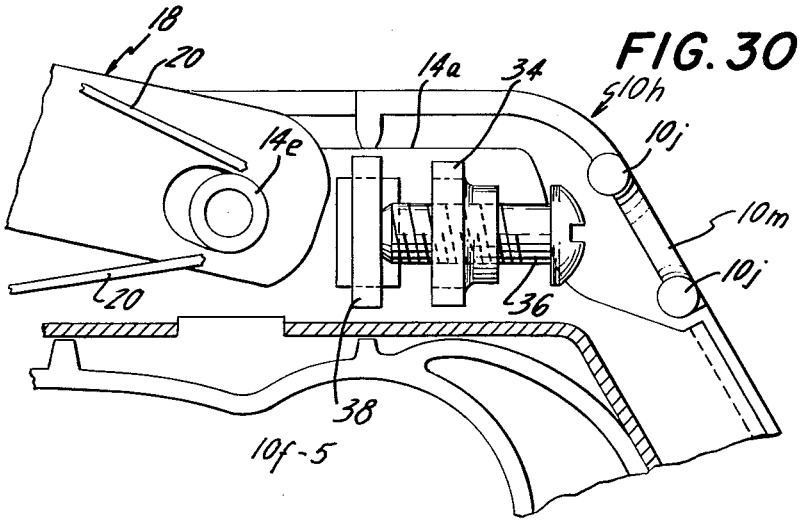
FIG. 30

FIG. 7
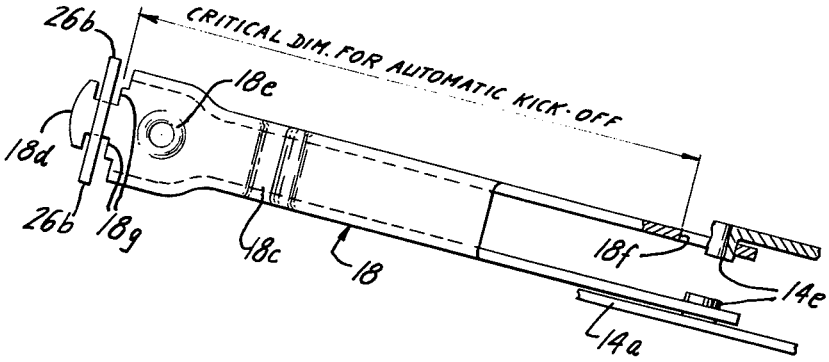
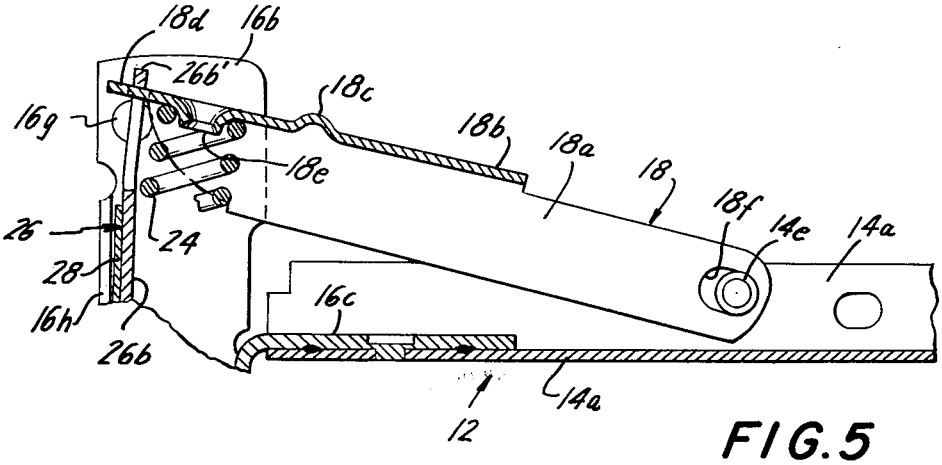
FIG. 5
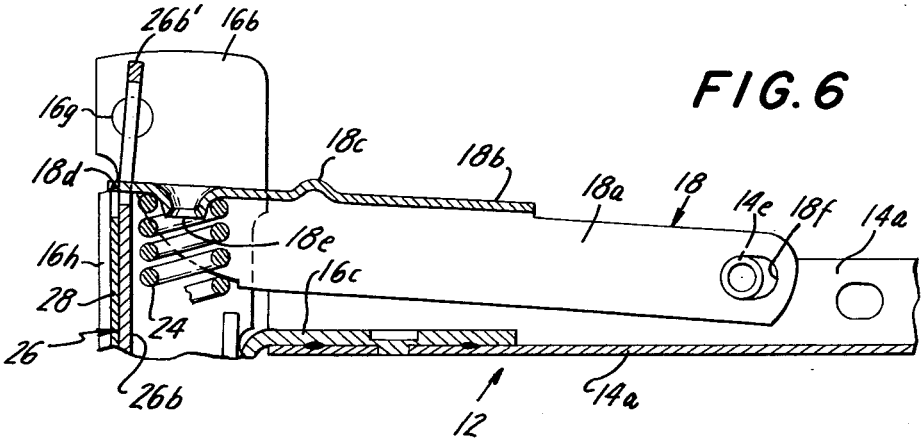
FIG. 6

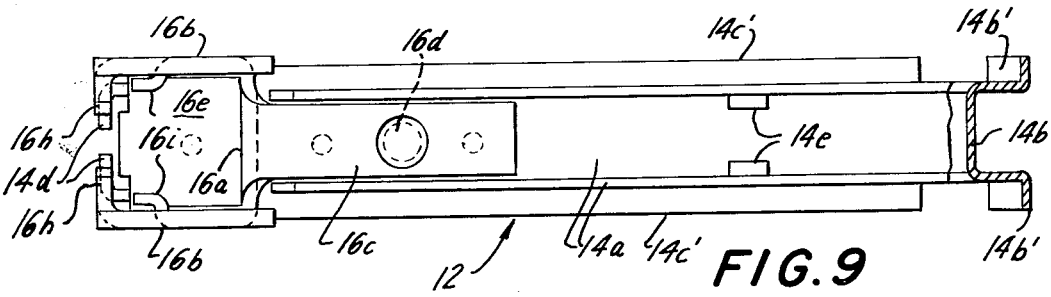
FIG. 9
FIG. 10
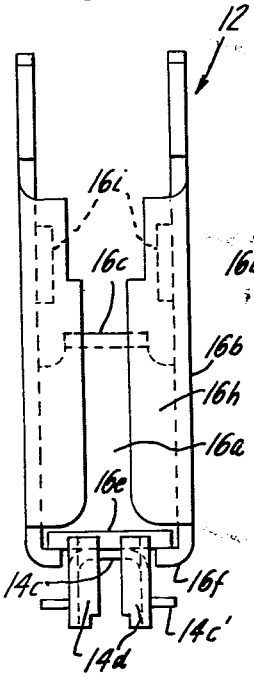
FIG. 8
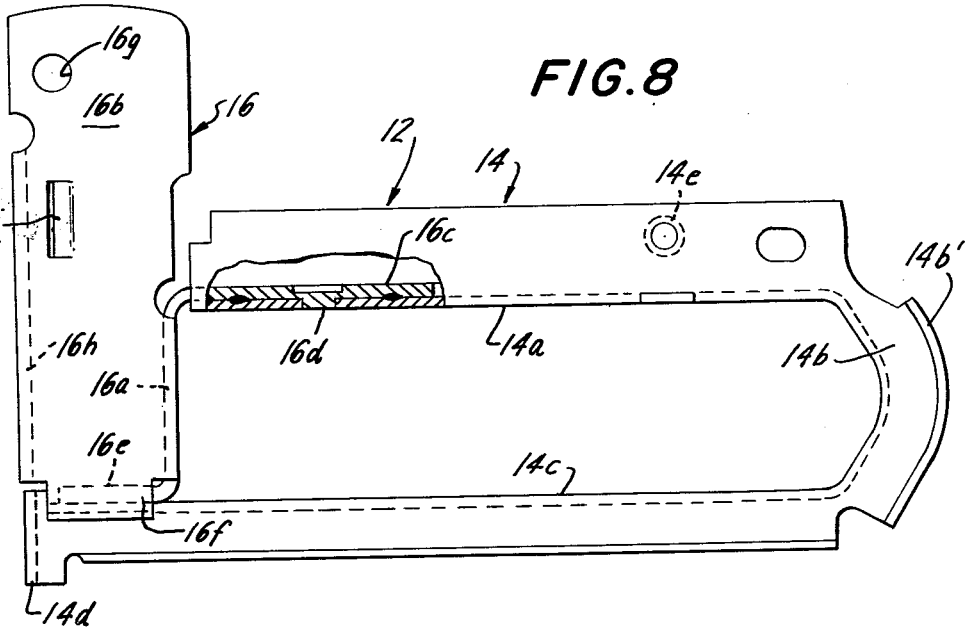
FIG. 11
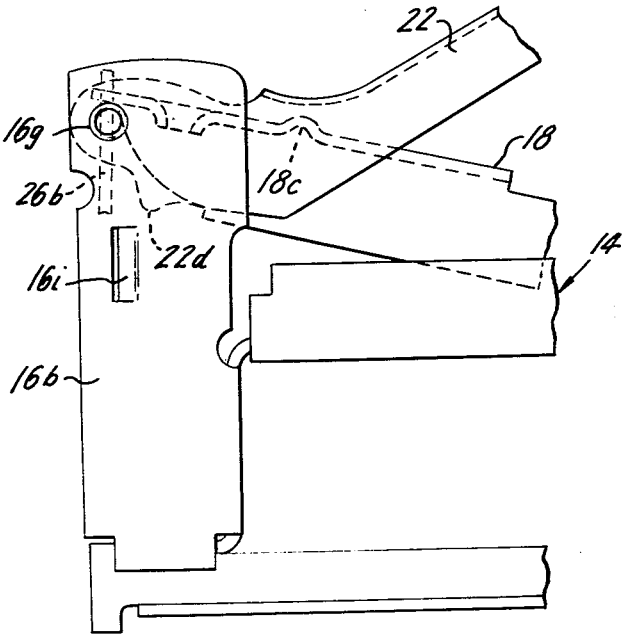
FIG. 12
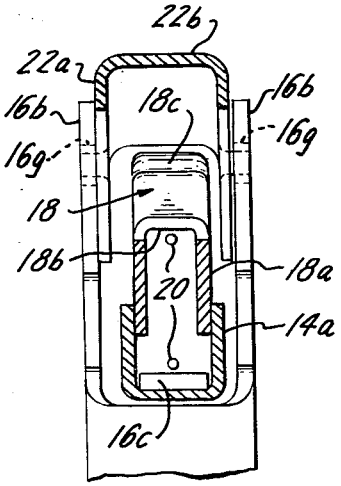

10f-3
10f-2

10i
10f
10d 10k
10f-6
24
10c
10f
10f-5
10f-4
16f-3
25
26
10e
10d
10i
10h
10b
10a
27
10g 10f-1
10f
10c
10d
10b
10a 10g
10g-1

28
10g
10g-1
10h
10a

STAPLE-DRIVING TOOLS

The present invention relates to tools for driving staples and, more specifically, to tackers.

BACKGROUND

A common characteristic of hand tooks called "tackers" is a spring-impelled staple driver and a manually operated actuator that first charges the spring and then releases a latch to free the staple driver for a spring-impelled stroke.

Most manual tackers (e.g. U.S. Pat. No. 3,948,426, issued to G. M. LaPointe) use a coil spring having a stationary end that bears against the frame. The opposite end of the spring is arranged to operate a staple-driving ram. An actuator first retracts the ram and compresses the coil spring. Then the ram is released to be impelled by the spring. As the ram is released, a recoil impulse develops which absorbs much of the energy stored in the spring. As a result of the waste, an oversize spring is needed for a given useful impulse at the staple-driving ram. In turn, an excessive manual operating effort is required for compressing the spring.

A different form of manual tacker is disclosed in U.S. Pat. No. 2,320,568 issued to J. F. Cavanaugh, in which the driven (lower) end of a coil spring provides the staple-driving impulse (as in LaPointe, supra) but in which the manual actuating means acts at the opposite (upper) end of the spring to compress the spring. In terms of efficient utilization of drive effort, the type of tacker in Cavanaugh is superior to the type represented by LaPointe. However, the Cavanaugh tacker is relatively bulky and requires many parts, and hence is costly to produce. Moreover the Cavanaugh type of tacker involves a staple-driving ram at one side of the staple driver and a pivoted latch at the opposite side. When the latch is levered away from the staple driver, a force is developed that tends to pull the staple-driving ram away from its guide surface and thus out of line with the staple to be driven. Additionally, there is a tendency of the staple driver to be rocked at the moment of release, giving rise to serious wear problems.

A problem has arisen in tackers of hazardous misuse. If a tacker is operated casually, away from an object that is to be tacked, a staple is ejected nonetheless, and represents a sharp emitted missile. The problem has been recognized in the LaPointe patent, supra, but not fully solved. In LaPointe, a safety device projects adjacent the staple-emitting passage. Once the tacker is pressed against a work surface, the safety device is pushed inward and renders the tacker operable. However, if the tacker is then lifted away from the work surface, it is fully operable with all the hazard of a tacker not equipped with a safety device.

SUMMARY OF THE INVENTION

An object of the present invention resides in providing a novel staple-driving tool of the type having a spring-impelled staple driver as an improvement in one or more respects over the foregoing, and in providing novel tackers improved in other respects.

In one aspect, the present invention provides a novel tacker of the type exemplified by Cavanaugh, yet simplified, and therefore more economical construction.

In another aspect of the present invention, a novel tacker is provided wherein the release means tends to shift the staple driver toward alignment with its slide guiding means, rather than away from its slide guide means. In a related aspect, a novel tacker is provided wherein a separate mechanically operable latch is replaced by a stationary latch and wherein the staple driver is released by shifting it off its latch and into its released path. Consistency and accuracy are realized by incorporating the stationary latch and the guide surfaces for the staple driver in a common part, thereby avoiding the accumulated tolerances of assembled mechanisms.

In a still further aspect of this invention, a novel tacker is provided having a safety feature that is effective to disable the tacker up to the very moment of release if the tacker is not then pressed against a staple-receiving surface.

The present invention provides additional novel features. Tackers are provided having a more economical frame structure, one that inexpensively provides significant mass at the staple-driving end of the frame and minimizes the mass of the frame where large mass does not help. Tackers are provided having a novel economically produced and applied jacket for introducing varied external designs to cover a standardized mechanism and for avoiding the expense of attractively and smoothly finishing the metal parts of the tacker enclosed by the jacket. Novel tackers are provided having a means for adjusting the staple-driving impact so that the tacker can be set for reduced impact when the work surface is soft and easily penetrated and would be excessively indented by a full impact.

The foregoing and other novel features of the invention are incorporated in the illustrative presently preferred tacker and certain modifications described in detail below and shown in the accompanying drawings. As will be readily understood, certain of the novel features may be utilized without others. The novel features are set forth more fully in relation to the detailed description below and in the claims. Further redundant recitation here of those features is avoided in the interest of clarity and conciseness.

IN THE DRAWINGS

FIG. 1 is a lateral view of a novel tacker embodying features of the present invention, and FIG. 2 is an elevation thereof as seen from the left of FIG. 1;

FIGS. 5 and 6 are fragmentary views of the tacker as shown in FIGS. 3 and 4, and FIG. 7 is a fragmentary top view, partly in cross-section, of the tacker in FIG. 5 as viewed perpendicular to a spring-compressor bar in FIG. 5;

FIG. 8 is a lateral view, partly in cross-section, of assembled frame parts of the tacker of FIGS. 1–7, and FIGS. 9 and 10 are a top plan view and a left-hand end view thereof, respectively, FIG. 9 being partially in cross-section;

FIG. 11 is a fragmentary elevation like FIG. 3 of a modification;

FIG. 12 is a fragmentary view of the tacker of FIGS. 1–10 as seen from the plane 12—12 in FIG. 3;

Figure 4:
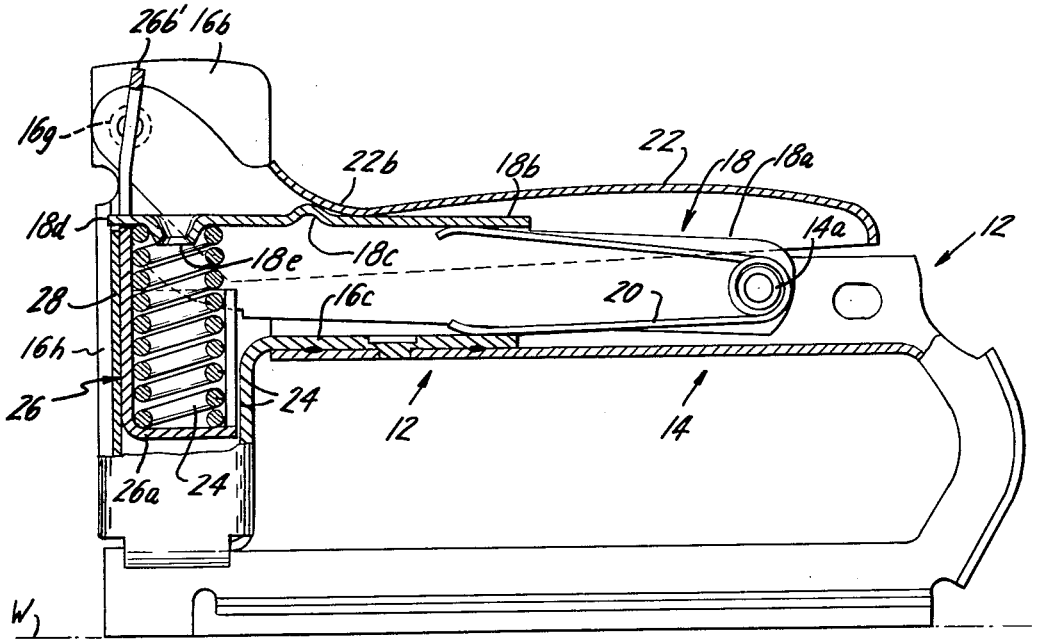
FIG. 4 is a similar view with the operating handle depressed just prior to release of the staple driver.
Figure 15:
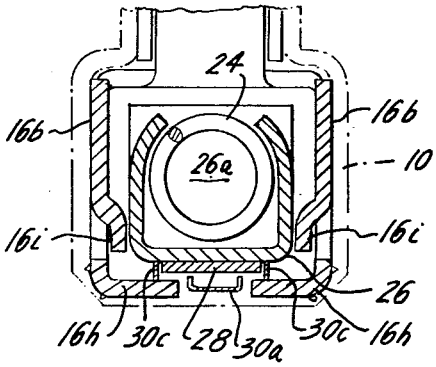
FIG. 15 is a fragmentary cross-section of the novel tacker at the plane 15—15 of FIG. 13, a portion of the plastic jacket being shown in phantom.
Figure 18:
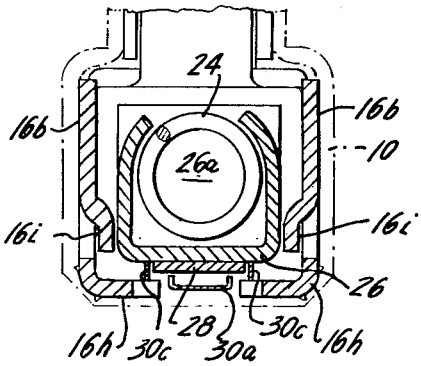
Figure 13:
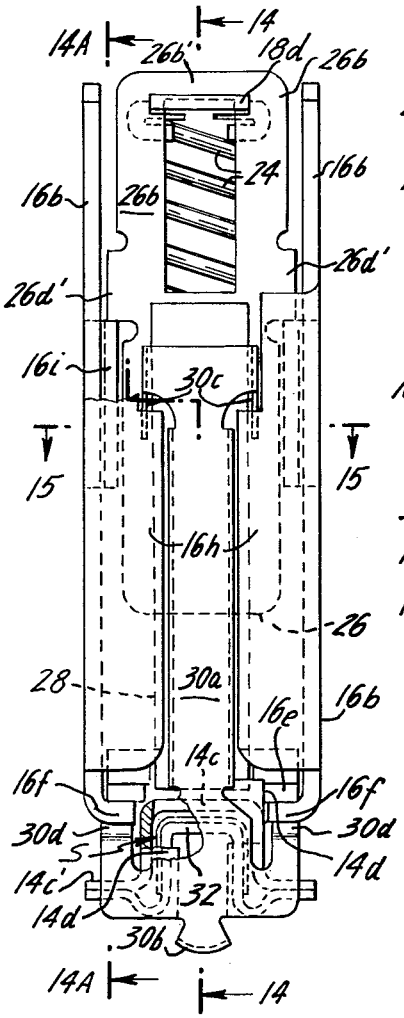
FIG. 13 is an enlarged fragmentary view, partly in cross-section, of the novel tacker as seen from the left of FIG. 3 with its work-surface feeler **30*b* projecting as in FIGS. 1 and 2**.
Figure 14:
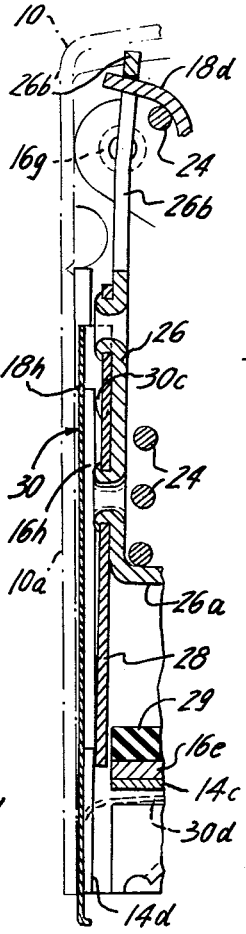
FIG. 14 is a fragmentary vertical cross-section of the novel tacker as seen at the plane 14—14 in FIG. 13, a portion of the plastic jacket being shown in phantom.
Figure 16:
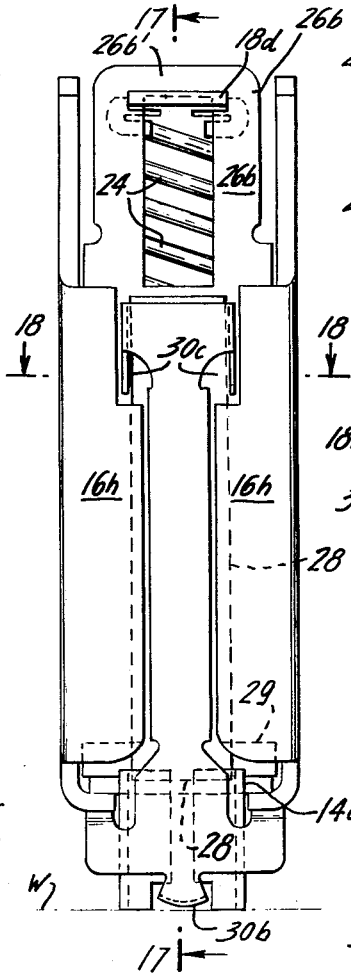
Figure 17:
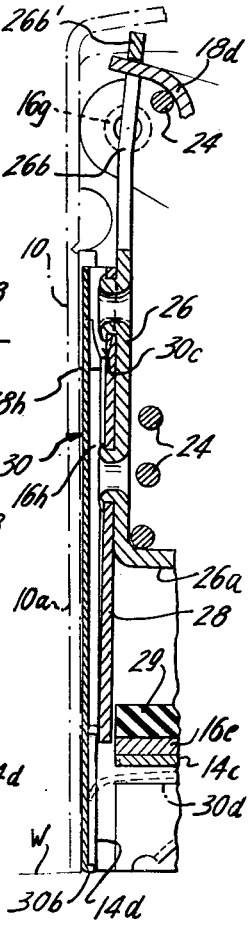
Figure 20:
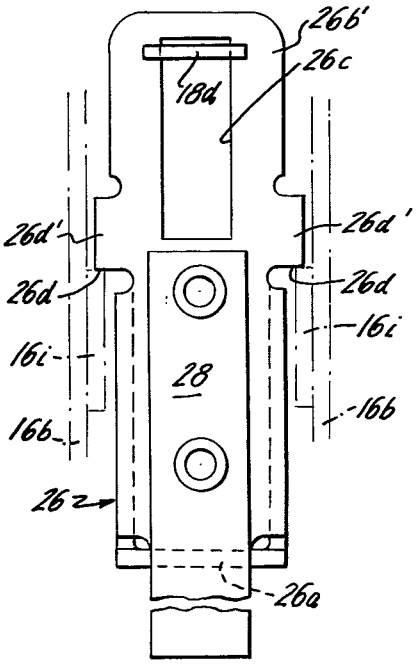
Figure 19:
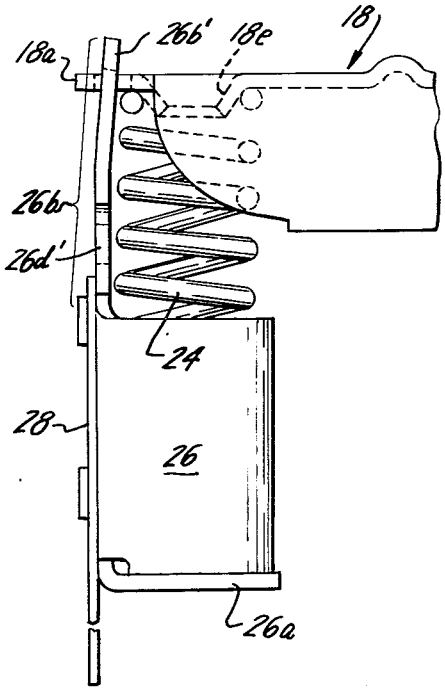
Figure 21:
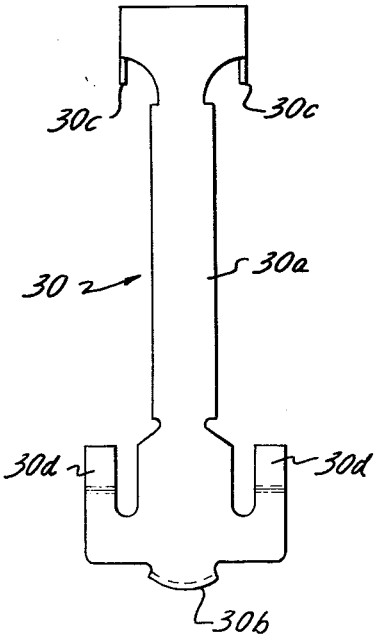
Figure 22:
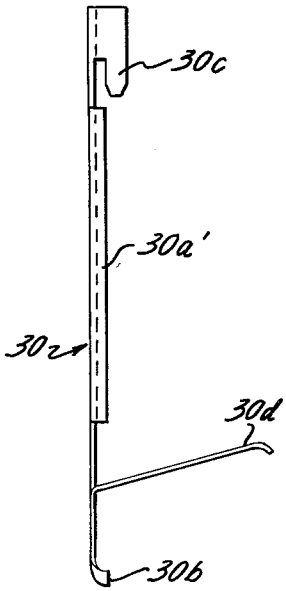

FIG. 16 is an enlarged fragmentary view like FIG. 13, showing the novel tacker with its work-surface feeler elevated due to its contact with a work surface, and FIGS. 17 and 18 are cross-sections corresponding to FIGS. 14 and 15, respectively, of the novel tacker as viewed at the planes 17—17 and 18—18 respectively in FIG. 16;

FIG. 19 is an enlarged fragmentary lateral view of components of the novel tacker as shown in FIG. 4 with the operating spring compressed, just prior to release of the staple driver; and FIG. 20 is an elevation viewed from the left of FIG. 19;

FIG. 21 is an enlarged view of the feeler shown as FIG. 13, and FIG. 22 is an elevation viewed from the right of FIG. 21.

Figure 3:
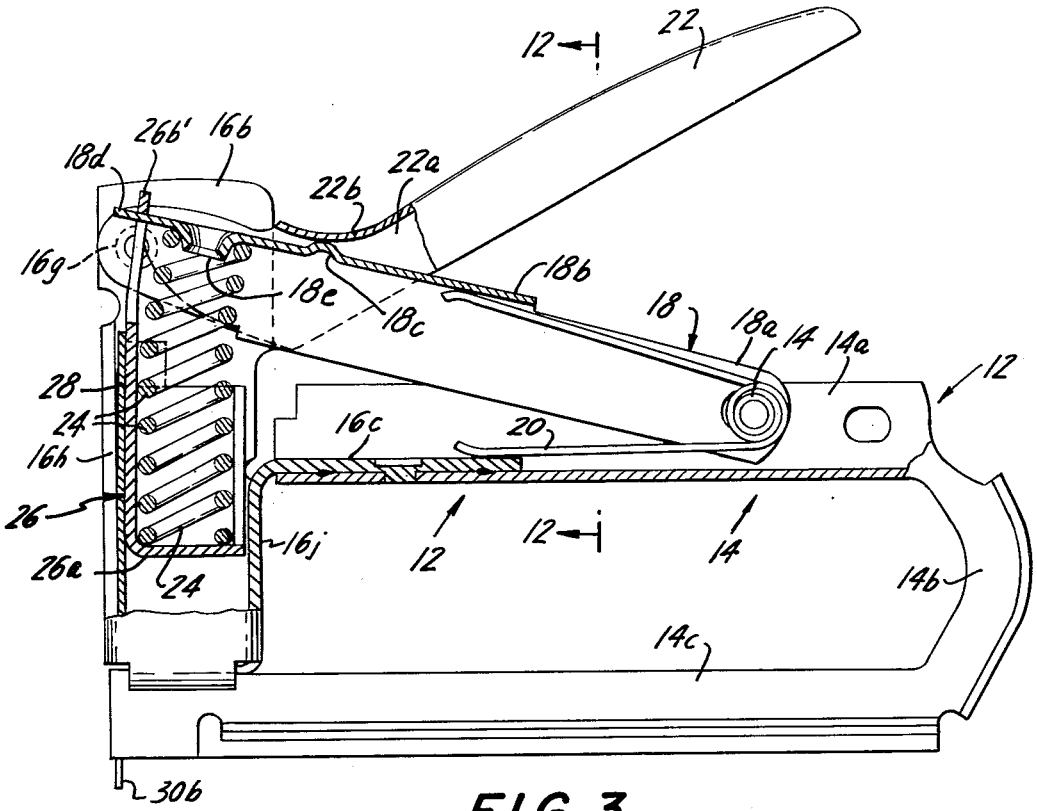
FIG. 3 is a lateral view, partly in cross-section, of the tacker in FIGS. 1 and 2 with its plastic jacket removed
Figures 23, 24, 25, 26, 27, 28:
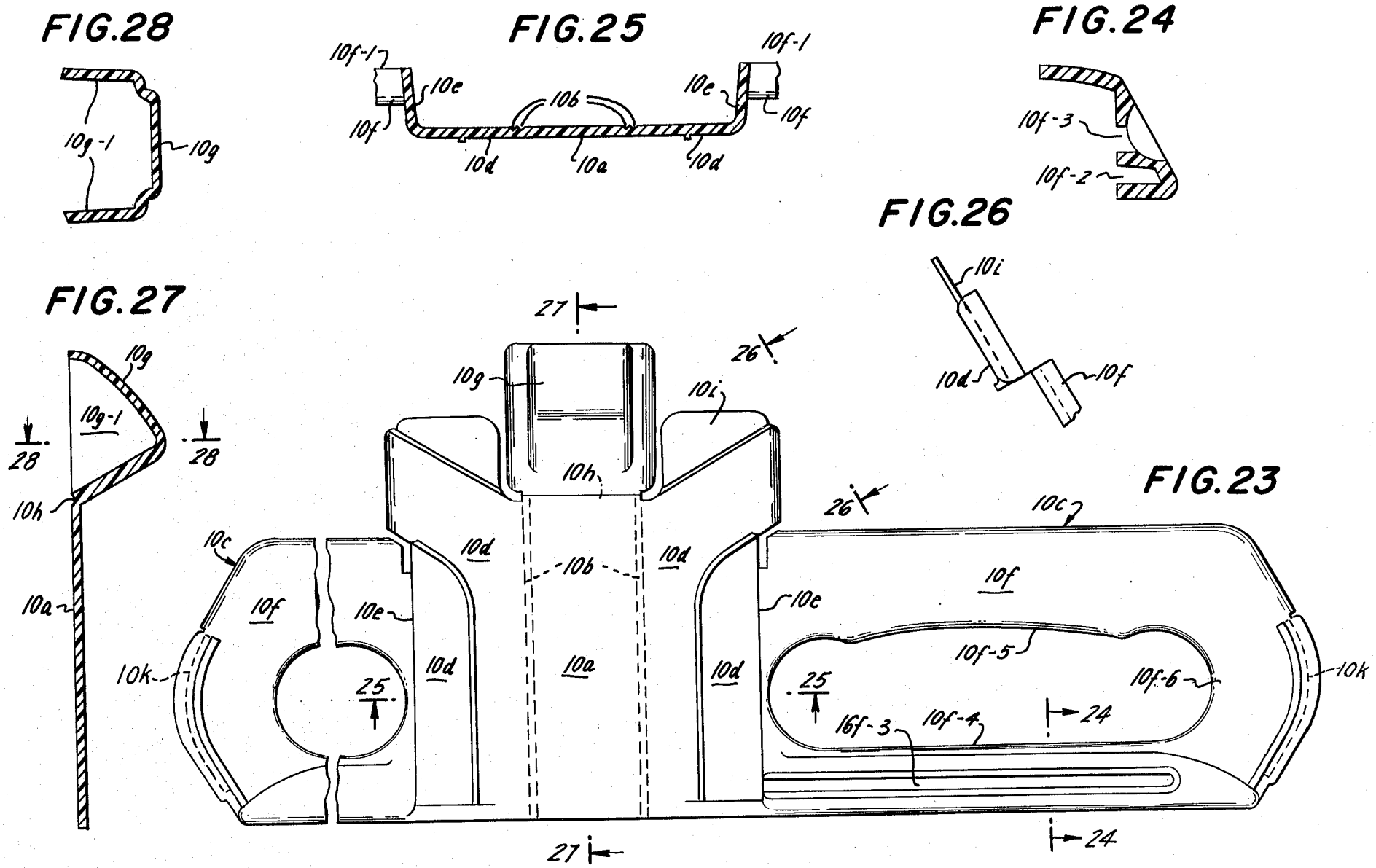

FIG. 23 is a fragmentary view of the plastic jacket of the novel tacker as shown in FIG. 1, to the same scale, the jacker being shown open in its as-molded condition;

FIG. 24 is an enlarged cross-section of a portion of the jacket as seen at the plane 24—24 of FIG. 23;

FIGS. 25–28 are cross-sections of the jacket shown in FIG. 23 as seen at the planes 25—25, 26—26, 27—27 and 28—28, respectively, in FIG. 23;

FIG. 29 is a cross-section of the jacket as seen at the plane 29—29 in FIG. 1; and FIG. 30 is an enlarged detail of a modified portion of the novel tacker of FIGS. 1–10 and 12–29, viewed as in FIGS. 1 and 3.

Referring to the drawings, a presently preferred embodiment of the novel tacker is shown in FIGS. 3 and 4 with the plastic jacket 10 of FIGS. 1 and 2 removed. The jacket is shown separately in FIGS. 23–29, and is described in detail below.

The tacker of FIGS. 3 and 4 comprises a frame 12 (FIGS. 8–10) formed of two metal parts 14 and 16. Part 14 is a stamping, distinctively made of a simple strip of relatively light-gage metal such as cold-rolled steel. Portions **14*a*, 14*b* and 14*c* of part 14 form a U-shaped unit. Part 16 is united to the free ends of the U-shaped unit, forming a hand hole. Each portion 14*a*, 14*b* and 14*c* is basically a channel of U-shaped cross-section having a web connecting two side walls. Cross-sections of portions 14*a* and 14*b* appear in FIGS. 12 and 9, respectively, and an end view of portion 14*c* appears in FIG. 13**.

At the left-hand end of the tacker as seen in FIG. 8, the side walls of the channel portion **14*c* have turned-in end flanges 14*d* (see also FIGS. 10, 13 and 14A) against which the leading end of a stick of staples is pressed. The staples are advanced inside frame portion 14*c*** by a spring-biased follower of conventional form (not shown).

Part 16 of frame 12 includes a web **16*a* (FIGS. 8–10) and two side walls 16*b*. A tang 16*c* extending from web 16*a* overlies the web of frame portion 14*a* and is resistance-welded to it. Advantageously, an extrusion 16*d* in tang 16*c* provides for accurate assembly of parts 14 and 16 in preparation for the weld. A further tang 16*e* extends at right angles from the lower end of web 16*a*. Tang 16*e* is welded to frame portion 14*c* (FIGS. 10 and 13**).

Frame 12 is thus a rigid unit comprising parts 14 and 16. The frame is readily fabricated of two stocks of strip steel. Part 16 can be made heavy and of a wear-resistant grade of steel while part 14 can be made of light-gage steel. The material of the two strips is utilized efficiently, with very little scrap. Mass is provided in portion 16 where it contributes resistance to recoil, and the frame is light elsewhere.

The present construction contrasts prominently with the usual "clam-shell" construction of tacker frames wherein two stampings are formed of a sheet of steel. In that construction, a pair of mirror-image stampings are assembled opposite each other, like the shells of a clam. Large areas are punched out of the stampings to form the hand opening here outlined by U-shaped part 14 and part 16. The blanked-out material of the openings in the clam-shell stampings represents substantial waste. Moreover, since a large mass of hard, wear-resistant material is needed at the staple-driver end of the frame, either the entire frame must be made of heavy, hard steel when it is formed of clam-shell stampings, or additional pieces of hard material must be united as laminations to the clam-shell stampings at the staple-driver end of the frame.

The frame of the present tacker, being formed of strip stock, achieves low manufacturing cost while allowing flexibility in choice of material for each part of the frame. Provision is thus made economically for large mass and hard material only where those qualities are needed, and there is no need to resort to a compromise gage or steel that is lighter than desired at the staple-driver end of the frame and needlessly heavy elsewhere.

FIGS. 3 and 4 show generally the mechanism of the illustrative tacker. The actuating mechanism for compressing coil spring 24 and for releasing the spring-impelled staple-driver (to be described) includes manual level 22 and actuating or spring-compressing bar 18. Actuating bar 18 is formed of a channel having side walls **18*a* and a connecting web 18*b*. (See also FIG. 12.) Bar 18 operates between the walls of frame portion 14*a* about pivots 14*e* (FIGS. 5–9) which are extruded from those walls. Torsion spring 20 bears down against frame 12 and up against web 18*b* of bar 18 and is coiled loosely about a pin (if required, but not shown) extending through pivots 14*e*. Manual lever 22 is generally channel-shaped, having side walls 22*a* connected by web 22*b*. Walls 22*a* flank the walls of actuating bar 18. A bump 18*c* is struck up from the web 18*b* of bar 18, defining the operating point of the manual level against the actuating bar. Lever 22 has outward-extruded pivots received in holes 16*g* of frame part 16. Lever 22 provides leverage acting at bump 18*c*, thus operating on nearly the full length of actuating bar 18** where these parts are proportioned as shown.

A compression coil spring 24 is confined between a locating protrusion **18*e* of actuating bar 18 and the lower end wall 26*a* of a spring container or "box" 26. In the raised configuration of the parts as shown in FIG. 3, spring 24 is precompressed. The degree of precompression is a design consideration. The left-hand end portion 18*d* of web 18*b* cooperates with an upstanding portion 26*b* of box 26. End portion 18*d* is necked-in and extends through a slot 26*c* in part 26*b* (FIG. 20). A portion 26*b*' of upward projection 26*b* overlies portion 18*d*, portions 18*d* and 26*b*' serving as a connection to maintain the pre-compression of spring 24**.

A staple-driving ram 28 (see also FIGS. 19 and 20) is fixed to box 26 as by rivets. Unified parts 26 and 28 constitute a staple-driving unit or, more briefly, a "staple driver". As seen in FIGS. 7 and 20, the forward or left-hand end of portion 18*d* of the actuating bar is T-shaped, having shoulders 18*d'* that extend outward to prevent portion 26*b* of spring-containing box 26 from accidentally slipping off the end of portion 18*d*. At all times in the arcuate motion of bar 18 there is clearance between upstanding portion 26*b* and the outward shoulders 18*d'*.

Frame part 16 has a pair of turned-in vertical flanges 16*h* (FIGS. 9 and 13) having parallel spaced-apart vertical edges. Box 26 reciprocates in frame part 16. The sides of this box 26 slide against portions 16*i* of the side walls 16*b* (FIG. 15) but box 26 is allowed to tilt toward and away from flanges 16*h* for a purpose discussed below. The downward pressure of spring 24 on box 26 produces clockwise bias on unit 26, 28 (as seen in FIG. 3) that presses ram 28 against the aligned inner surfaces of flanges 16*h* and of turned-in flanges 14*d* (see FIGS. 10, 11 and 14A for example) at the staple-driving end of frame portion 14*c*.

In use, manual lever 22 and frame part 14*a* are gripped by the user. Lever 22 is forced downward, driving bar 18 downward until a staple has been driven. During most of this motion box 26 is arrested, while compression builds in spring 24. Portion 18*d* of the actuating bar moves downward in slot 26*c* (FIG. 20) in the upward-extending portion 26*b* of the spring-containing box 26.

The parts are shown in FIG. 4 in their configuration just before box 26 is released. After release of the staple-driving unit, the front surface of staple-driving ram 28 slides in contact with flanges 16*h* and with turned-in end portions 14*d* of frame portion 14*c*.

As seen in FIGS. 8, 9, 14, 14A and 15, abutments 16*i* are struck inward from the side walls 16*b* of the frame. As noted above, these abutments provide side guides for box 26. The upper edges 16*i'* of those abutments form latches. Box portion 26*b* (FIG. 20) has shoulders 26*d* at the lower edges of wings 26*d'*. Shoulders 26*d* bear against latches 16*i'* after manual lever 22 is depressed very slightly. Box 26 has a rightward tilt at this time. This latched configuration of box 26 and frame part 16 endures until the moment of release.

The presently preferred manner of release of the staple driver comprising box 26 and staple-driving ram 28 may now be described in connection with FIGS. 5–7 and 14A. Compression builds up in spring 24 as bar 18 swings to the position in FIGS. 4 and 6 from that in FIGS. 3 and 5. FIG. 7 shows actuating bar 18 as seen from above and at a slight angle to FIG. 5.

An elongated opening or slot 18*f* is formed in the walls of actuating bar 18, which receive cylindrical pivots 14*e*. In the normal, at-rest condition of the parts as shown in FIG. 5, coil spring 24 biases bar 18 to the left (as more fully explained below) so that pivots 14*e* are pressed against the right-hand ends of slots 18*f*.

Figure 14A:
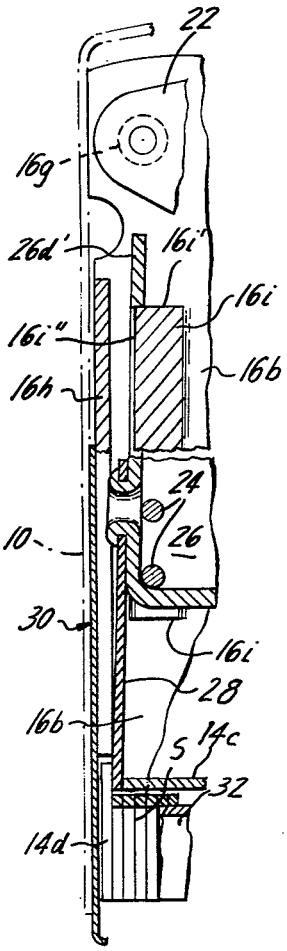
FIG. 14A is an enlarged fragmentary view in cross-section like FIG. 14 but at the broken line 14A—14A in FIG. 13.

Downward operation of manual lever 22 and actuating bar 18 causes bar 18 to move in an arc about pivots 14*e*. This occurs until shoulders 18*g* engage upward extension 26*b* of the spring-containing box which is latched (FIG. 14A) by abutments 16*i*. As downward movement of bar 18 continues after shoulders 18*g* engage upward extension 26*b*, the spring-container remains latched and in tilted position due to friction at latches 16*i'* and shoulders 26*d* of wings 26*d'* (FIGS. 13 and 14A), causing bar 18 to shift to the right until the left-hand ends of slots 18*f* bear against pivots 14*e*. Thereafter, bar 18 moves arcuately and its shoulders 18*g* (FIG. 6) force box extension 26*b* toward the left. The front of the box becomes essentially vertical and parallel to frame flanges 16*h*. Referring to FIG. 14A, wings 26*d* shift off latch surfaces 16*i'* of abutments 16*i*, releasing staple-driving unit 26, 28 for spring-impelled operation. At the end of the staple-driving stroke of unit 26, 28, spring 24 has become extended but not so far as to cause part 26*b'* to strike projection 18*d* of bar 18. Just before that occurs, box 26 strikes a rubbery bumper 29.

Both before and after release of the staple driver 26, 28, coil spring 24 bears downward on the bottom of box 26, providing a clockwise bias acting to press ram 28 (FIG. 14A) against frame parts 16*h* and 14*d*. After the instant of release, wings 26*d* slide along guide surfaces 16*i''* of abutments 16*i*. The same clockwise bias of spring 24 acting on the bottom of box 26 also acts to cause wings 26*d'* to bear against guide surfaces 16*i''* during this sliding motion. The construction assures consistent performance among many of these tackers despite normal tolerances of the parts. Notably, each flange 16*h* at the front of staple driver 26, 28 is formed in the same part (frame part 16) as guide surfaces 16*i''* on abutments 16*i*. Therefore, in production of many of these tackers, guide surfaces 16*h* and 16*i''* will have a consistent and accurate relationship, without concern for assembly tolerances.

As a further advantage of this construction, there is no tendency of the latch-releasing operation to draw the staple-driver away from its guiding surface aligned with the staple in driving position.

As a further advantage of this construction, there is inherent assurance of guiding the staple driving unit along its guide surfaces with only a small (if any) angle between the sliding parts. The relationship is readily maintainable consistently in producing these tackers. The relationship also avoids a serious wear condition that is common among many known tackers in which the staple driving unit impacts against a guide surface at the moment of release.

Following a staple-driving operation, manual lever 22 is released by the user for spring-actuated retraction. Actuating bar 18 is swung upward initially by spring 24, raising lever 22 accordingly until projection 18*d* engages portion 26*b'* of the spring container 26. This connection maintains the initial precompression in spring 24.

As bar 18 continues to swing upward, operated by torsion spring 20, it carries parts 24, 26 and 28 up as a unit. Staple driver 26, 28 is constrained to move essentially vertically due to the engagement of its wings 26*d'* with guide surfaces 16*i''*. During this swinging motion of bar 18, the upper end of spring 24 draws bar 18 to the left until pivots 14*e* engage the right-hand extremities of slots 18*f*. Thereafter as spring 20 continues to raise bar 18, the upper end of spring 24 is forced toward the right during the purely arcuate motion of bar 18. However the lower half of spring 24 is constrained by box 26 to be essentially vertical, due to its engagement with the right-hand wall of the box. Consequently the upper half (approximately) of spring 24 is forced to tilt to the right. Sidewise pressure of the spring 24 against box 26 between the ends of the spring presses wings 26*d'* against guide surfaces 16*i''*. As soon as box 26 is raised high enough for wings 26*d'* to clear abutments 16*i*, spring 24 shifts the staple driver 26, 28 sidewise, snapping wings 26d' into position over latch surfaces 16i'. Upward movement of bar 18 continues (as limited by manual lever 22) until a limited clearance develops between latch surfaces 16i' and wing shoulders 26d. Subsequently when a staple is to be driven, spring 24 provides a bias that assures the latching cooperation of the wings 26d' with abutments 16i.

The described actuation of the upper end of spring 24 downward by bar 18 has distinct advantages over tackers that lift the lower end of the impelling spring of the staple driver prior to latch release. At the moment of release of the staple driver in any tacker, its sudden motion develops a reverse-acting recoil impulse in spring 24. That recoil impulse is applied to bar 18 in the illustrated tacker. The user's hand bears against lever 22, acting almost directly over bump 18c. Thus, the user's hand inherently provides a downward force that is actually in effect at the very instant that the upward recoil impulse develops. The resistance to that impulse provided by the user's downward pressure is effectively converted into augmented staple-driving effort. One result is that a weaker spring can be used to achieve equal drive effort as compared to tackers of the type in which the spring is both compressed and released from the same end. Conversely, for tackers of both types having equal springs with equal amounts of precompression, the present tackers deliver greater staple-driving effort.

As an alternative to reliance on shoulders 18g to effect release of shoulders 26d from the latch surfaces 16i', indeed as a supplement to assure such release, manual lever 22 in the modification of FIG. 11 is provided with a cam 22d that cooperates with upstanding portion 26b of the staple-driving unit 26, 28. Cam 22 pushes wings 26d' off latch surfaces 16i' after the desired build-up of compression in spring 24. Either of the described forms of release are effective, and both may be used together.

The illustrative tacker thus far described is useful and complete. However it is here equipped with a safety device which, were it omitted, would not impair the performance of the tacker per se. This feature suppresses operation of the tacker at all times except while it is being pressed against a staple-receiving object, up to the very moment of release of the staple driver. This feature is described in reference to FIGS. 13–18. (In FIGS. 3 and 4, the scale is too small for the safety device to be shown as part of the mechanism.)

The safety feature is imparted to the illustrative tacker by including interposer or feeler 30. Feeler 30 of resilient metal (FIGS. 21 and 22) includes a long, thin and narrow body portion 30a with marginal stiffening flanges 30a' along most of its length. Body portion 30a extends downward to a projecting portion 30b (see FIG. 3) and extends upward to form a two-walled interponent 30c. Leaf springs 30d integral with feeler 30 flank body portion 30a near its lower end.

FIGS. 13–15 represent the tacker with feeler portion 30b projecting, as in FIG. 3. Leaf springs 30d act against turned-in lips 16f of the tacker's frame. Body portion 30a of the feeler is received loosely between turned-in flanges 16h of the frame, in front of the unit 26, 28 and within the plastic jacket 10. The lower end portion of feeler 30 is received between jacket 10 and turned-on lips 14d of the frame (FIGS. 9, 10, 13 and 14). Unit 26, 28 is elevated, and actuating bar portion 18d bears against the top of slot 26c in spring-containing box 26. Staple S (FIG. 13) is in the drive position below driver 28. Staple S is part of a stick of staples supported on rail 32 and biased (by a conventional staple-stick pusher, not shown) against turned-in lips 14d. Rail 32 has flanges united to opposing flanges 14c of frame part 14c. Sticks of staples may be loaded onto rail 32 at the end remote from the staple-driving unit.

Notably, with feeler 30 projecting as in FIGS. 13 and 14, interponents 30c are located in the space between the front surface of the spring container and the rear or inner surfaces of flanges 16h. Interponents 30c are here shown as straddling staple driver 28.

In this condition, it will be recognized that the tacker cannot be operated to drive a staple because unit 26, 28 is tilted back a bit, with its shoulders 26d (FIG. 20) arrested on the top latching edges 16i' of abutments 16i. Release of the staple-driving unit is prevented by the interponents which block releasing movement of the unit 26, 28 from its latches. Thus, there is virtually no way to "tease" the tacker by preliminary manipulation without the feeler being depressed at the moment of release of the staple-driving unit. Consequently, the tacker cannot be used thoughtlessly to eject a staple as a missile into open space.

FIGS. 16–18 correspond to FIGS. 13–15, but show the mechanism with feeler portion 30b' pressing against a staple-receiving work piece W, in the elevated position of the feeler. Interponents 30c are raised out of cooperation with turned-in lips 16h of the frame. Consequently the feeler is in no condition to interfere with the forward tilting of the staple-driving unit 26, 28. Shoulders 26d can readily be shifted off abutments 16i by operation of shoulders 18g of actuating bar 18 (FIG. 7) or by operation of cams 22d (FIG. 12) for releasing the staple driver.

Plastic jacket 10 virtually encloses the tacker. By providing this jacket, numerous problems are avoided. Electroplating many metal parts for improved appearance and for protection against corrosion becomes unnecessary, and the design of the operating parts is not complicated by consideration of their appearance if (otherwise) they were to be exposed to view. Notably, the entire tacker can be restyled readily to create varied impressions on the buyer. In that way, several designs of jacket can be used with the identical mechanism. Different custom designs can be used to identify a variety of proprietary tackers with each of several distributors.

The tacker construction as described above is economically contained in a one-piece molded plastic jacket 10 shown in FIGS. 23–29. The jacket is molded "open" or basically flat, and it is adapted to be wrapped around the front (the left-hand end of the tacker as in FIG. 3) and then permanently secured in place. In FIG. 23, jacket 10 comprises a central panel 10a having thinned side margins 10b (FIGS. 23 and 25) acting as hinges to join panel 10a with sides or wings 10c and 10c' of the jacket. Each side 10c, 10c' includes a vertically elongated panel 10d and right-angled portions 10e (FIG. 25). Each wing 10c, 10c' also includes portions 10f that complement part 14 of the frame. As seen in FIG. 24, the lower length 10f-4 and the upper length 10f-5 and the rear length 10f-6 each has an edge 10f-1 that abuts a like edge of the other wing. Lower length 10f-4 of each wing has a groove 10f-2 that receives the opposed and united flanges of frame part 14c and staple-supporting rail 32 (FIG. 13). A further slot 10f-3 in lower length 10f-4 of wing 10c is provided for accommodating a projecting finger piece on a spring-biased pusher (not shown) for a stick of staples on rail 32. The upper lengths 10f-5 and the rear portions 10f-6 (right-hand end in FIG. 1) are complementary to frame portions 14a and 14b, respectively. Aside from slot 10f-3, wings 10c, 10c' are mirror-image counterparts of each other.

In assembling jacket 10 to frame 12, the front panel 10a of the jacket is first pressed against turned-in flanges 16h at the left end of the frame and wings 10c and 10c' are bent about hinges 10b against the opposite sides of frame parts 16 and 14. Flaps 10i extending from panels 10d of the jacket fit against side portions 16b of the frame. Cupped portion 10g of the jacket is then swung as a cap over the upper ends of frame portions 16b. Side walls 10g-1 of the cupped portion enclose flaps 10i (FIGS. 23 and 26).

Wings 10 advantageously have complementary small knob-and-socket "poppet" formations along the abutting edges of wing portions 10f-4, 10f-5 and 10f-6. Such complementary interlocking formations may be located judiciously, as at points 10j in FIG. 30 (sheet 1). They snap together and hold the abutting edges against each other.

The jacket is more permanently held in place by cement applied to flaps 10i and to the abutting edges 10f-1. No holding clamps or fixtures are needed to hold the jacket while the cement sets, where the interlocking formations are used. Flanges 14b' of frame part 14 (FIGS. 8 and 9) are received in mating channels 10k (FIG. 23) as a further means for locking jacket 10 in place.

It was explained above in connection with FIG. 7 that shoulders 18g of the actuating bar operate to release or unlatch the staple driver 26, 28. That occurs when ample stored energy has developed in spring 24. The release point may be made adjustable.

It may be desirable to reduce the driving effort of the tacker, as when working on easily-indented material that can assuredly be penetrated by staples using less driving impact. FIG. 30 illustrates an adjustment that may be readily incorporated into the tacker described above for reducing the staple-driving effort of unit 26, 28. Release of staple driver 26, 28 is adjusted to occur earlier in the spring-charging stroke of lever 22. For this purpose, a bushing 34 is fixed to the opposite walls of frame portion 14a, and a screw 36 is threaded into the bushing. Aperture 10m in modified jacket 10A provides access to screw 36 for making the adjustment. The screw abuts and operates a movable pressure plate 38 that has projections slidably captive in rectangular holes in the walls of frame portion 14a. Plate 38 replaces the left-hand ends of slots 18f as the compression bar 18, becoming effective as lever 22 nears the end of its stroke. For maximum staple-driving effort, plate 38 can be adjusted so that part 26b becomes unlatched from (is pushed off) abutments 16i due to coaction of the left-hand end of slots 18f with pivots 14e. Adjustment of plate 38 for earlier coaction with actuating bar 18 causes release or push-off of unit 26, 28 earlier in the operating stroke of the manual lever 22 when less-than-maximum build-up of the spring energy has developed. This is one way to provide for ample staple-driving impact for heavy work while rendering the tacker adaptable to conditions where less impact is wanted. In the embodiment of FIG. 11, the same effect is realized by forming pivot 16g of the handle as an eccentric whose adjustment changes the unlatching point variably in relation to the spring-compressing stroke of the handle.

As a general comment, the accompanying drawings are to scale. However, the thicknesses of a number of parts are not faithfully represented in some instances. Frame part 16 is of heavy stock and spring containing box 26 is of somewhat lighter gage. Both of these parts are intended to be relatively massive to contribute inertia that resists an initial recoil impulse and to contribute to the staple-driving impulse. Frame part 14, including its portion 14d, are of much thinner stock than either of elements 16 and 26. Staple-driving ram 28 is quite thin, being slightly thinner than a staple to be driven and much thinner than frame part 14.

The nature of the invention in its various aspects has been expressed in connection with the presently preferred illustrative embodiment and modifications. Other embodiments of the invention may readily be devised by those skilled in the art, and certain of the novel features may be used without others. Consequently, the invention should be construed broadly in accordance with its true spirit and scope.

What is claimed is:

1. A tacker including a fixed latch, a staple driver, means for guiding said staple driver along a reciprocating path adjacent said latch between driven and retracted positions, said guiding means accommodating shift of said staple driver out of said reciprocating path when the staple driver is retracted to be restrained by said latch, said tacker including spring means for impelling said staple driver toward said driven position and means providing bias tending to shift said staple driver out of said reciprocating path and into position restrained by said latch, and actuating means for progressively increasing the stored energy in said spring means while said staple driver is restrained by said latch and operative thereafter for shifting said staple driver out of position restrained by said latch and thereby releasing the staple driver for a spring-impelled operation.

2. A tacker as in claim 1 wherein a common spring constitutes both said spring means and said biasing means.

3. A tacker as in claim 1 wherein said spring means comprises a compression coil spring, one end of which acts on said staple driver toward said driven position and the other end of which is acted on by said actuating means.

4. A tacker as in claim 1 wherein a compression coil spring constitutes both said spring means and said biasing means, said coil spring being arranged to tilt said staple-driving unit at an angle to said reciprocating path so as to bias said staple-driving unit as aforesaid at least when said staple driver is retracted.

5. A tacker as in claim 1 wherein a compression coil spring constitutes both said spring means and said biasing means, and wherein said actuating means includes an actuating bar for compressing said spring, said bar being operatively connected to one end of said coil spring and being arranged to stress the spring for tilting said staple driver at an angle to the reciprocating path so as to act as said biasing means at least when said bar is in its initial position.

6. A tacker as in claim 1 or claim 5, wherein said actuating means includes a member arranged to be manually operated in the direction toward said driven position so as to provide a force resisting the recoil that develops when the staple driver is released.

7. A tacker as in claim 1, wherein said actuating means includes an actuating bar and wherein said spring means comprises a compression coil spring operatively connected at one end thereof to said bar, said actuating bar and said staple driver having a connection therebetween that maintains a pre-bias in the spring when the bar is in its initial unoperated position.

8. A tacker as in claim 5, wherein said actuating bar and said staple driver have a connection that maintains precompression in the spring when the bar is in its initial unoperated position.

9. A tacker as in claim 5, wherein said actuating bar is arranged to shift said staple driver into its position unrestrained by said latch after the bar has been operated to increase the energy stored in said spring.

10. A tacker as in claim 1, wherein said actuating means comprises a pivoted bar arranged to shift said staple-driving unit out of its position restrained by said latch.

11. A tacker as in claim 1, wherein said actuating means includes a manual lever bearing a cam cooperable with said staple driver to shift said staple driver out of its position restrained by said latch.

12. A tacker as in claim 10 or claim 11, including manually operable means for adjusting the release point of the staple driver in relation to the aforesaid progressive increase of stored energy in the spring means.

13. A staple-driving tool having a frame, a reciprocable staple driver and actuating means for said staple driver, said actuating means including a manual operating lever, said frame including an elongated unitary first part of sheet metal which comprises first, second and third portions arranged as a U-shape providing a hand hole, said portions being largely of U-shaped cross-section having webs along the perimeter of the hand hole, said manual operating lever being assembled to said frame opposite to said first portion for enabling said lever and said first portion to be manually squeezed toward each other, said frame including a second part of sheet metal joined to extremities of said first and third portions of the first part and forming a fourth portion of the hand hole completing the perimeter thereof, said second part forming a guide for said staple driver.

14. A staple-driving tool as in claim 13, wherein said actuating means includes a spring for impelling the staple driver in staple-strokes and latching means for arresting said staple driver against staple-driving movement, and means including said manual operating lever for charging said spring and then releasing said latching means to initiate a staple-driving stroke of the staple driver, and wherein said second part is of sheet metal, said second part being of substantially heavier-gauge metal than said first part.

15. A staple-driving tool including a frame, a reciprocable staple-driving unit, and actuating means for said reciprocable unit, said frame having first, second and third portions arranged as a U-shape and a fourth portion across the ends of the U-shape so that the frame defines a hand-hole, said fourth portion constituting an enclosing guide for said staple-driving unit, said fourth portion having a side facing the hand-hole and an opposite side remote from the hand-hole, said actuating means including a manual lever opposite to and spaced from the first portion of said U-shape, and a jacket of one-piece molded plastic largely enclosing said frame, said jacket comprising a central portion at the side of said fourth frame portion remote from the hand-hole and a pair of wings extending from opposite margins of said central portion and flanking the lateral surfaces of all said frame portions, the pair of wings lining the hand-hole, the wings having mutually engaging edges at the hand-hole and having peripheral mutually engaging edges.

16. A staple-driving tool including a reciprocable staple driver, means defining a staple-delivery guide, spring means for impelling the staple driver for emitting a staple at said staple-delivery guide, means for latching said staple driver against operation by said spring means, and actuating means for initially charging said spring means and for releasing the latching means so as to free the staple driver to emit a staple, said tool further having a safety device including a feeler near said staple-delivery guide and biased to project from the tool, said safety device comprising means maintaining said staple driver latched so long as the feeler projects.

17. A staple-driving tool as in claim 16 wherein said last-named means is arranged to obstruct release of said staple driver by said actuating means while the feeler projects.

18. A staple-driving tool as in claim 16 wherein said latching means comprises a stationary latch and a portion of said staple driver engageable with said latch, further including means for guiding said reciprocable staple driver along a reciprocating path adjacent said stationary latch between retracted and driven positions, and means for shifting the staple driver sidewise from said path and into restraint by said stationary latch, said safety device including a portion disposed in position to disable shift of said staple driver out of restraint by said latch so long as said feeler projects.

19. A tacker including an elongated reciprocable staple driver having a staple-driving ram at one end thereof and means providing a first guide surface for guiding said staple-driving ram along a reciprocating path between retracted and driven positions, spring means for impelling said staple driver toward said driven position and for biasing said ram against said first guide surface, said spring means acting on a portion of said elongated staple driver relatively close to said one end, actuating means for developing stored energy in said spring means, and latching means releasably cooperating with a latchable portion of said staple driver remote from the staple-driving end of said ram and spaced substantially from the portion of the staple driver where said spring acts, said actuating means including means for releasing said latching means after development of stored energy in said spring means.

20. A tacker as in claim 19 wherein said latching means comprises a stationary abutment having a latch portion providing a latching shoulder and a second guide surface for guiding said latchable portion of the staple driver along said reciprocating path and transverse to said shoulder, said spring means being arranged for not only biasing said ram against said first guide surface as aforesaid, but additionally for biasing a portion of said staple driver spaced substantially from said ram against said second guide surface after release of the staple driver and, when the staple driver is in its retracted position, for biasing said portion of said staple driver out of said reciprocating path and into position for cooperation of said latchable portion thereof with said latching surface of said abutment.

* * * * *